US005103844A

United States Patent [19]

Hayden et al.

[11] Patent Number: 5,103,844

[45] Date of Patent: Apr. 14, 1992

[54] CIGARETTE PAPER AND CIGARETTE INCORPORATING SAME

[75] Inventors: Rhonda F. Hayden, Winston-Salem; Elbert C. Jones, Jr., Sherrill's Ford; Jerry W. Lawson, Clemmons, all of N.C.; Richard L. Lehman, Belle Mead, N.J.; Patricia F. Perfetti, Winston-Salem, N.C.

[73] Assignee: R. J. Reynolds Tobacco Company, Winston-Salem, N.C.

[21] Appl. No.: 534,785

[22] Filed: Jun. 7, 1990

[51] Int. Cl.[5] ..... A24D 1/00

[52] U.S. Cl. ..... 131/365; 131/336

[58] Field of Search ..... 131/365, 336

[56] References Cited

U.S. PATENT DOCUMENTS

| | | | |
|---|---|---|---|
| 2,181,614 | 1/1939 | Striefling . | |
| 2,580,608 | 1/1952 | Schur et al. . | |
| 2,733,720 | 2/1956 | Schur et al. . | |
| 2,738,791 | 3/1956 | Schur et al. . | |
| 2,890,704 | 6/1959 | Lamm . | |
| 2,998,012 | 8/1961 | Lamm . | |
| 3,044,924 | 7/1962 | Schur . | |
| 3,049,449 | 8/1962 | Allegrini . | |
| 3,744,496 | 7/1973 | McCarty et al. | 131/365 |
| 4,152,408 | 5/1979 | Winslow . | |
| 4,231,377 | 11/1980 | Cline et al. . | |
| 4,420,002 | 12/1983 | Cline . | |
| 4,433,697 | 2/1984 | Cline et al. . | |
| 4,450,847 | 5/1984 | Owens . | |
| 4,461,311 | 7/1984 | Mathews et al. . | |
| 4,779,631 | 10/1988 | Durocher et al. | 131/336 |
| 4,805,644 | 2/1989 | Hampl, Jr. et al. . | |
| 4,881,557 | 11/1989 | Martin . | |
| 4,915,118 | 4/1990 | Kaufman et al. . | |
| 4,938,238 | 7/1990 | Barnes et al. | 131/365 |
| 4,941,485 | 7/1990 | Perfetti et al. | 131/336 |

FOREIGN PATENT DOCUMENTS 0357359 3/1990 European Pat. Off. .

OTHER PUBLICATIONS

Skurauskis et al., "Franklin Fiber: A MicroFiber Filler/Reinforcement", *Plastics Compounding*, p. 27 (May/Jun. 1984).

*Primary Examiner*—Vincent Millin
*Assistant Examiner*—Lynne A. Reichard

[57] ABSTRACT

Cigarettes have a tobacco rod including smokable material circumscribed by a paper wrapper. The paper wrapper includes a cellulosic base web (e.g., flax and/or wood pulp fibers) and particles of at least one inorganic filler material. The inorganic filler material includes calcium sulfate, and normally fibers of calcium sulfate having an aspect ratio of about 30.

18 Claims, 1 Drawing Sheet

CIGARETTE PAPER AND CIGARETTE INCORPORATING SAME

BACKGROUND OF THE INVENTION

The present invention relates to paper, and in particular, to paper useful for the manufacture of cigarettes.

Popular smoking articles, such as cigarettes, have a substantially cylindrical rod shaped structure and include a charge of smokable material, such as shredded tobacco (e.g., cut filler), surrounded by a paper wrapper thereby forming a so-called "tobacco rod." It has become desirable to manufacture cigarettes having cylindrical filter elements aligned in an end-to-end relationship with the tobacco rod. Typically, a filter element is manufactured from cellulose acetate tow circumscribed by paper plug wrap, and is attached to the tobacco rod using a circumscribing tipping paper. It also has become desirable to perforate the tipping paper and plug wrap, in order to provide for dilution of drawn mainstream smoke with ambient air.

Papers useful for the manufacture of cigarettes normally include a cellulosic web (e.g., flax or wood pulp fibers), an inorganic filler material (e.g., particles of calcium carbonate), and burn additives (e.g., potassium citrate). Various papers useful for the manufacture of cigarettes are set forth in U.S. Pat. Nos. 2,580,608 to Schur et al; 2,181,614 to Striefling; 2,738,791 to Levy et al; 3,044,924 to Schur; 3,049,449 to Allegrini; 3,744,496 to McCarty et al; 4,433,697 to Cline et al; 4,420,002 to Cline; 4,231,377 to Cline et al; 4,461,311 to Mathews et al; 4,450,847 to Owens; 4,805,644 to Hampl, Jr. et al; 4,779,631 to Durocher et al and 4,915,118 to Kaufman et al.

It would be desirable to provide a paper, and particularly, a paper useful for the manufacture of cigarettes.

SUMMARY OF THE INVENTION

The present invention relates to paper, and in particular, to a paper having calcium sulfate incorporated therein as a filler material. Most preferably, at least a portion of the filler material is fibers of calcium sulfate. A typical paper of the present invention comprises (i) a cellulosic base web (e.g., flax and/or wood pulp fibers), and (ii) inorganic filler material which includes fibers of calcium sulfate (i.e., a fibrous form of calcium sulfate).

Papers of the present invention are useful as wrappers in the manufacture of cigarettes and other smoking articles. In particular, papers of the present invention can circumscribe a charge of smokable material to form a tobacco rod. As such, the papers of the present invention burn along with the smokable material when the cigarette is smoked.

Cigarettes of the present invention, when smoked, yield an ash which is cohesive, exhibits good integrity and is not flakey. In addition, such cigarettes tend to burn back in a uniform manner at a desirable rate, in order that such cigarettes provide a desirable number of puffs. Further, preferred cigarettes do not provide an undesirable off-taste and off-aroma to the mainstream and sidestream smoke generated thereby; and are capable of generating relatively low levels of visible sidestream smoke when the wrapping papers of the present invention are of a suitably low air permeability.

DETAILED DESCRIPTION OF THE PREFERRED EMBODIMENTS

Figure 1:
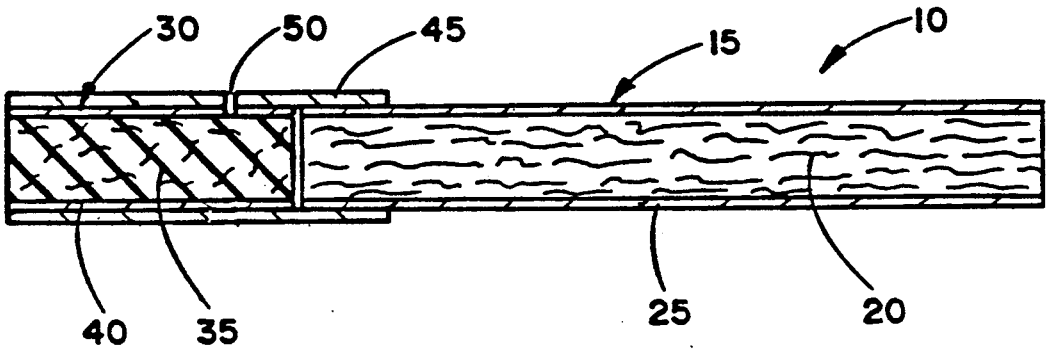
FIG. 1 is a longitudinal sectional view of a cigarette of the present invention.

One embodiment of a cigarette of the present invention is shown in FIG. 1. Cigarette 10 includes a generally cylindrical rod 15 of a charge or roll of smokable filler material 20 contained in circumscribing wrapping material 25. The rod 15 is conveniently referred to as a "smokable rod" or a "tobacco rod." The ends of the tobacco rod are open to expose the smokable filler material.

The cigarette 10 normally includes a filter element 30 or other suitable mouthpiece positioned ad3acent one end of the tobacco rod 15 such that the filter element and tobacco rod are axially aligned in an end-to-end relationship, preferably abutting one another. Filter element 30 has a generally cylindrical shape, and the diameter thereof is essentially equal to the diameter of the tobacco rod. The ends of the filter element are open to permit the passage of air and smoke therethrough. The filter element 30 includes filter material 35 which is overwrapped along the longitudinally extending surface thereof with circumscribing plug wrap material 40. The filter element can have two or more filter segments, and/or flavor additives incorporated therein.

The filter element 30 is attached to the tobacco rod 15 by tipping material 45 which circumscribes both the entire length of the filter element and an adjacent region of the tobacco rod. The inner surface of the tipping material 45 is fixedly secured to the outer surface of the plug wrap 40 and the outer surface of the wrapping material 25 of the tobacco rod, using a suitable adhesive. A ventilated or air diluted smoking article is provided with an air dilution means, such as a series of perforations 50, each of which extend through the tipping material and plug wrap.

Typically, the tobacco rod has a length which ranges from about 50 mm to about 85 mm, and a circumference of about 16 mm to about 28 mm. The tobacco rods and the resulting cigarettes can be manufactured in any known configuration using known cigarette making techniques and equipment.

Typically, the filter element has a length which ranges from about 20 mm to about 35 mm and a circumference of about 16 mm to about 28 mm. The filter material can be any suitable material such as cellulose acetate, polypropylene, tobacco material, or the like. Examples of suitable filter materials are cellulose acetate tow items having (i) about 3 denier per filament and about 35,000 total denier, and (ii) about 3.5 denier per filament and about 35,000 total denier. Such tow items conveniently provide filter elements exhibiting a removal efficiency of particulate matter from mainstream smoke of greater than about 40 weight percent. The plug wrap typically is a conventional paper plug wrap, and can be either air permeable or essentially air impermeable. However, if desired, a nonwrapped cellulose acetate filter element can be employed. Filter elements having two or more segments, and which are provided using known plug-tube-combining techniques, also can be employed. The various filter elements suitable for use in this invention can be manufactured using known cigarette filter making techniques and equipment.

The smokable filler material employed in the manufacture of the smokable rod can vary. The preferred filler material is an "American blend" of tobacco materials. For example, the smokable filler can include a blend of flue-cured, Burley, Maryland, Oriental, reconstituted and volume expanded tobaccos. Other suitable blends are described in European Patent Application No. 290,911 and U.S patent application Ser. No. 416,332, filed Sept. 29, 1989. The filler material also can include those types of smokable materials described in U.S. patent application Ser. Nos. 276,161, filed Nov. 23, 1988 and 414,833, filed Sept. 29, 1989.

The smokable filler materials generally are employed in the form of cut filler as is common in conventional cigarette manufacture. For example, the smokable filler material can be employed in the form of shreds or strands cut into widths ranging from about 1/10 inch to about 1/60 inch, preferably from about 1/20 inch to about 1/40 inch. Generally, such pieces have lengths which range from about 0.25 inch to about 3 inches.

As used herein, "packing density" means the weight of the smokable filler material which occupies a unit volume within the smokable rod. For cigarettes of the present invention, the packing density generally ranges from about 100 mg/cm$^3$ to about 300 mg/cm$^3$, more typically from about 150 mg/cm$^3$ to about 275 mg/cm$^3$.

Flavorants can be incorporated into the cigarettes. For example, the smokable filler materials can be employed with casing or top dressing additives. See, for example, Leffingwell et al, *Tobacco Flavoring for Smoking Products* (1972). Flavorants such as menthol can be incorporated into the cigarette using techniques familiar to the skilled artisan. If desired, flavor additives (e.g., organic acids) can be incorporated into the cigarette as additives to the cut filler. See, U.S. Pat. No. 4,830,028 to Lawson et al.

Typically, the tipping material circumscribes the filter element and an adjacent region of the tobacco rod such that the tipping material extends about 3 mm to about 6 mm along the length of the tobacco rod. Typically, the tipping material is a conventional paper tipping material. The tipping material can have a porosity which can vary. For example, the tipping material can be essentially air impermeable, air permeable, or be treated (e.g., by mechanical or laser perforation techniques) so as to have a region of perforations, openings or vents thereby providing a means for providing air dilution to the cigarette. The total surface area of the perforations and the positioning of the perforations along the periphery of the cigarette can be varied in order to control the performance characteristics of the cigarette.

The basis weights of the wrapping materials for the tobacco rod can vary. Typical basis weights for such wrapping materials range from about 10 g/m$^2$ to about 40 g/m$^2$, and often are about 20 g/m$^2$ to about 30 g/m$^2$. Typical basis weights do not exceed about 80 g/m$^2$, and are usually less than about 50 g/m$^2$.

Wrapping materials for the tobacco rod can have a wide range of permeabilities or porosities. Typical wrapping materials have inherent permeabilities which are below 550 CORESTA units, frequently are below about 450 CORESTA units, often are below about 350 CORESTA units, and sometimes are below abdut 100 CORESTA units. Wrapping materials can be electrostatically perforated to increase the net permeabilities thereof, particularly when the wrapping material has a low inherent porosity. Techniques for electrostatically perforating wrapping materials for cigarettes are apparent to the skilled artisan.

The thickness or caliper of the wrapping materials for the tobacco rod can vary. Typical thickness for such wrapping materials are less than about 0.3 mm, often are less than about 0.2 mm, and frequently are about 0.1 mm or less.

Typical wrapping materials are paper wrapping materials which contain about 45 to about 85, preferably about 65 to about 80 weight percent cellulosic material; and about 15 to about 55, preferably about 20 to about 35 weight percent filler material.

The wrapping material can include at least one other inorganic filler material component in addition to the calcium sulfate filler component. Such other inorganic filler materials include particulate calcium carbonate (e.g., precipitated calcium carbonate), magnesium oxide, magnesium hydroxide, dolomite, agglomerated particles of precipitated calcium carbonate, and the like.

The calcium sulfate filler component for the paper wrapping materials of the present invention most preferably has a fibrous form (e.g., is in the form of fibers). The fibers can be described as microfibers, having a whisker, acicular or needle-like crystal shape. Normally useful fibrous calcium sulfate is available as Franklin Fiber A-30, A-45, H-30, H-45 and P-1 from U.S. Gypsum Corp. The fibrous calcium sulfate can have a hemihydrate or anhydrous form. The fibrous calcium sulfate also can have a "dead burned" form, which is provided by heat treating the hemihydrate or anhydrous forms of the fibrous calcium sulfate. Typically, fibers of calcium sulfate have lengths of about 30 microns to about 200 microns, preferably about 30 microns to about 120 microns, and most often about 60 microns to about 90 microns; and diameters of about 2 microns. Preferred fibers of calcium sulfate have aspect ratios of about 30 to about 60. See, Skurauskis et al, *Plastics Compounding*, p. 25 (May/June, 1984). The fibers of calcium sulfate can be combined with particulate calcium sulfate (e.g., in anhydrous, hemihydrate or dihydrate form). Exemplary particulate calcium sulfate is available as Beta Stucco and Terra Alba from U.S. Gypsum Corp.

Preferred paper wrapping materials contain at least about 1 weight percent fibrous calcium sulfate, more preferably at least about 5 weight percent fibrous calcium sulfate. Typically, the wrapping materials do not contain more than about 55, and preferably do not contain more than about 35 weight percent fibrous calcium sulfate. As such, all or a portion of the filler material of the preferred wrapping material is fibrous calcium sulfate.

The preferred papers also contain flax fibers, wood pulp, esparto fiber, sisal fibers, or other cellulosic material to provide a cellulosic base web. Mixtures of 2 or more types of cellulosic materials can be employed.

A portion of the inorganic filler material can have the form of particles of an agglomerated matrix of inorganic material. A particularly preferred inorganic filler material is agglomerated calcium carbonate, and most preferably, agglomerated precipitated calcium carbonate. Such materials are prepared by providing an aqueous slurry of calcium carbonate particles and a binding material, and drying the slurry to form an agglomerated matrix of calcium carbonate (i.e., a matrix of a plurality of calcium carbonate particles spaced within a continuous or semi-continuous phase of binding agent). Calcium carbonate particles which are employed to provide the agglomerated matrix typically exhibit a surface area of less than about 1 $m^2/g$, as determined using the Brunauer, Emmett and Teller (BET) method described in *J. Am. Chem. Soc.*, Vol. 60, p. 309 (1938). The binding material employed to provide the agglomerated matrix of inorganic material can be an organic material or an inorganic material. Typical organic binding materials are cellulosic derivatives (e.g., sodium carboxymethylcellulose), and often are sugar containing materials, such as molasses, high fructose corn syrup, or Carob Powder Code 1739 from M. F. Neal, Inc. Typical inorganic binding materials include ortho phosphoric acid, potassium carbonate, sodium carbonate, and a glassy sodium polyphosphate available as Glass H from FMC Corp. Preferably, a high solids content aqueous slurry of calcium carbonate and binding material is spray dried to provide agglomerated particles (e.g., normally spherical particles) of calcium carbonate particles and binding material; and the resulting particles can be ground to a smaller size, if desired. Alternatively, the slurry can be dried by the application of heat to provide a solid mass of agglomerated calcium carbonate and binding material, and the solid mass can be ground to yield particles of the desired size.

The agglomerated matrix of inorganic filler material and binding material is subjected to heat treatment. Heat treatment causes inorganic binding agent to act to fuse the individual particles of the inorganic filler material together, and hence form the agglomerated structure or form. Heat treatment causes volatile components from organic binding material to be expelled, and calcine the organic binding material to form a water insoluble, carbonaceous material. A carbonaceous material consists primarily of carbon. Normally, the heat treatment of the agglomerated matrix is provided under controlled atmosphere, in order to minimize or prevent oxidation of organic binding material. When the binding agent is organic, the heat treatment provides a binding material which is carbonaceous, and in turn, provides a means for agglomerating the inorganic filler particles into a matrix form. The agglomerated calcium carbonate and binding agent particles can be heat-treated using an oven, a fluidized bed, rotary calciners, belt calciners, or the like. For example, spray dried calcium carbonate particles agglomerated using molasses can be heated in a fluidized bed having gaseous nitrogen heated at about 300° C. to about 425° C. flowing therethrough, and collected. After such a calcining process, the agglomerated calcium carbonate particles normally have a calcium carbonate content of greater than about 90 weight percent. Normally, the resulting agglomerated particles are screened to the desired size. Preferred agglomerated calcium carbonate and organic binding material particles which have been calcined are spherical in shape, are free flowing, and exhibit a bulk density of about 0.75 $g/cm^3$ to about 0.9 g/cm . As such, certain agglomerated calcium carbonate particles can provide an inorganic filler material having a bulk density less than about 2 $g/cm^3$, and preferably less than about 1 $g/cm^3$, which includes an inorganic component having a bulk density greater than about 2.5 $g/cm^3$ Normally, such agglomerated calcium carbonate particles exhibit a surface area of less than about 15 $m^2/g$, and often less than about 10 $m^2/g$, as determined using the BET method.

Methods for providing agglomerated calcium carbonate particles are set forth in U.S. patent application Ser. No. 414,833, filed Sept. 29, 1989.

Agglomerated inorganic particles useful as inorganic filler materials for wrapping materials typically have diameters of less than about 100 microns, usually less than up to about 50 microns, and preferably less than about 25 microns. The particulate inorganic filler materials can have a fairly narrow distribution of particle sizes, or a fairly wide range of particle sizes can be employed. Typically, relatively high levels of inorganic filler materials of relatively large particle size provide wrapping materials having high porosities.

Agglomerated particles including calcined organic binding agent are very dark in color, and as such, wrapping materials incorporating such agglomerated particles can have a unique gray color or even be very dark in color. If desired, dark colored wrapping materials including agglomerated particles having calcined organic binding agent as a filler material component can be employed as inner wrappers of smokable rods. See, for example, U.S. Pat. Nos. 3,744,496 to McCarty et al and 4,561,454 to Guess.

The agglomerated inorganic particles are capable of acting as substrates for certain additives, and as such, certain additives can be incorporated into wrapping materials which incorporate such agglomerated particles as an inorganic filler component. For example, the agglomerated inorganic particles can have incorporated therein burn enhancers, ash conditioners, catalytic agents, oxidizing agents, pigments, flavoring agents (e.g., vanillin, cocoa, licorice, menthol, organic acids and tobacco extracts), flavor precursors (e.g., ethylvanillin glucoside and vanillin glucoside), and the like. The manner in which the additive is incorporated into the agglomerated particles can vary; and a particular additive can be incorporated in the agglomerated particles (i) by dissolving or dispersing the additive within a solvent, impregnating the agglomerated particles with the solvent and additive, and removing a significant amount of the solvent from the agglomerated particles; (ii) by incorporating the additive into the slurry of paper components during the paper manufacturing steps, such that the additive becomes impregnated within the agglomerated particles; or (iii) by applying the additive to the finished paper using gravure printing or size press techniques. Wrapping materials incorporating flavoring agents and/or flavor precursors in the agglomerated filler material thereof can be used as wrappers of the smokable rods of cigarettes so as to provide flavored and aromatic mainstream and sidestream smoke.

Wrapping materials of the present invention are manufactured using known paper making techniques. In particular, there is formed a slurry of cellulosic material (e.g., flax and/or wood pulp) in water; and inorganic filler material then is added to the slurry. If desired, papermaking additives, such as retention aids (e.g., calcium hydroxide or calcium acetate), can be incorporated into the slurry. A paper web then is formed on a screen or fabric; and the resulting web then is dried using known techniques. If desired, the paper can be manufactured so as to have verge lines. Methods for manufacturing paper materials are described in U.S. Pat. Nos. 4,450,847 to Owens and 4,881,557 to Martin as well as in *Handbook of Pulp and Paper Technology*, edit. by Britt (1970), and *Handbook for Pulp & Paper Technologists*, Smook (1982).

Wrapping materials for cigarettes often incorporate at least one burn enhancer or ash conditioner therein. Examples of burn enhancers include water soluble alkali metal salts such as sodium and potassium salts of citric acid, hydrochloric acid, carbonic acid, acetic acid, malic acid, succinic acid, tartaric acid, hydrochloric acid, nitric acid, propionic acid, carbonic acid, fumaric acid and glycolic acid. However, other burn enhancers can be employed. Typically, the burn enhancer or ash conditioner is incorporated into the wrapping material in an amount up to about 15 percent, generally up to based on the dry weight of the base wrapping material. In addition, the burn enhancer typically is incorporated into the wrapping material in an amount greater than about 0.25 percent, generally greater than about 1 percent, and frequently greater than about 3 percent, based on the dry weight of the base wrapping material. For many wrapping materials, the amount of burn enhancer incorporated therein ranges from about 0.3 to about 3 percent, based on the dry weight of the base wrapping material.

The manner in which burn enhancer or ash conditioner is incorporated into the paper wrap can vary. The burn enhancer can be incorporated into the paper during the manufacturing process. Alternatively, the burn enhancer can be incorporated into the paper using size press techniques, painting techniques, rotogravure techniques, or the like. Such techniques will be apparent to the skilled artisan. It is highly preferred that the burn enhancer be incorporated into the paper in an essentially uniform manner throughout the paper. Various burn enhancers can be incorporated into the paper simultaneously, or at different processing stages during or after paper manufacture.

The wrapping material of the smokable rod can be coated with a coating or film which includes a polymeric material. The preferred polymeric material has film-forming capabilities so as to form a coating or film over the surface of the wrapping material to which it is applied. Examples of polymeric materials include nitrocellulose, hydroxypropylcellulose, methylcellulose, carboxymethylcellulose and polyvinylacetate. If desired, specific polymeric materials can be employed in conjunction with suitable plasticizers (e.g., nitrocellulose can be employed in conjunction with dibutyl phthalate). The polymeric material can be soluble in an aqueous solvent or other solvents (e.g., ethylacetate, isopropylacetate or ethanol). Preferably, the polymeric material has a relatively low molecular weight in order to ensure easy application thereof to the wrapping material.

The coating optionally can include an inorganic filler material such as magnesium hydroxide, magnesium oxide, magnesium sulfate, magnesium carbonate, particulate calcium sulfate, calcium sulfate fibers and calcium carbonate. Combinations of two or more inorganic fillers can be employed. The inorganic filler is employed in the form of particles, normally in the range of about 0.3 micron to about 3 microns in diameter. Typically, the inorganic filler particles are fairly small, in order that an aesthetically pleasing (i.e., a non-grainy) surface is provided to the wrapping material. Preferred inorganic fillers provide an intumescent character to the wrapping material to which that filler is applied.

The following examples are provided in order to further illustrate the invention but should not be construed as limiting the scope thereof. Unless otherwise noted, all parts and percentages are by weight.

EXAMPLE 1

Cigarettes having lengths of about 84 mm and circumferences of about 24.85 mm have tobacco rod lengths of about 57 mm and filter element lengths of about 27 mm. The tobacco rod includes a charge of tobacco cut filler, weighing about 0.7 g to about 0.75 g contained in a circumscribing cigarette paper wrapper. The cut filler employed in providing the tobacco rod is in the form of strands of tobacco cut at about 32 cuts per inch. The tobacco cut filler includes an "American blend" of tobacco materials.

The paper wrapper includes about 72 parts wood pulp (about 4 parts hardwood pulp and about 1 part softwood pulp) having a Canadian freeness of 80 to 120; about 13 parts precipitated calcium carbonate available as Albacar 5970 from Pfizer Inc.; and about 15 parts fibrous calcium sulfate available as Franklin Fiber A-30 from U.S. Gypsum Corp. The precipitated calcium carbonate has the form of particles averaging about 2 microns in diameter and having a generally rosettic structure. The calcium sulfate fibers have a generally acicular crystalline shape, and an aspect ratio of about 30 (i.e., a diameter of about 2 microns and a length of about 60 microns).

The paper wrapper exhibits a basis weight of about 26 $g/m^2$; a net porosity of about 520 CORESTA units; a thickness of about 0.1 mm; an opacity of about 72 percent as determined using a BNL-2 Opacimeter from Technidyne Corp.; a brightness of about 87 percent as determined by using a Brightmeter from Technidyne Corp.; and has a lineny appearance. The paper wrapper can be readily rolled around tobacco cut filler to form a tobacco rod.

The paper wrapper is manufactured forming an aqueous slurry of wood pulp and inorganic filler at about 17° C. in a "Noble & Wood" sheetmaking mold having a 150 U.S. Mesh stainless steel wire screen. The slurry containing mold is gravity drained, and the resulting sheet is transferred to a flat-bed dryer set at about 98° C. The sheet is dried to a moisture content of about 2 percent.

The filter element is manufactured using conventional cigarette filter making technology from a cellulose acetate tow item (3.3 denier per filament, 44,000 total denier) and circumscribing paper plug wrap.

The tobacco rod and filter element have similar circumferences, are aligned in an abutting, end-to-end relationship, and are secured together using tipping material. The tipping material is adhesively secured to the filter element and the adjacent portion of the tobacco rod. The tipping material circumscribes the 5 length of the filter element and about 4 mm of the length of the tobacco rod. The paper wrapper is positioned such that the "felt side" thereof faces the outside of the cigarette.

The cigarette is smoked, and the paper wrapper and tobacco cut filler burn to yield smoke. The cigarette delivers tobacco smoke flavor as well as an acceptable draft resistance. The mainstream smoke does not have an off-taste, and the cigarette yields desirable smoking satisfaction. The cigarette burns at an acceptable rate and yields a cohesive ash having a good integrity. The cigarette provides an "after-taste" which is not highly intense and is not undesirable in its organoleptic character.

EXAMPLE 2

Cigarettes having lengths of about 84 mm and circumferences of about 24.85 mm have tobacco rod lengths of about 57 mm and filter element lengths of about 27 mm. The tobacco rod includes a charge of tobacco cut filler, weighing about 0.7 g to about 0.75 g, contained in a circumscribing cigarette paper wrapper.

The cut filler employed in providing the tobacco rod is in the form of strands of tobacco cut at about 32 cuts per inch. The tobacco cut filler includes an "American blend" of tobacco material.

The paper wrapper includes about 72 parts of the wood pulp described in Example 1; about 18 parts of the precipitated calcium carbonate described in Example 1; and about 10 parts of the fibrous calcium sulfate described in Example 1. The paper is manufactured as described in Example 1.

The paper wrapper exhibits a basis weight of about 27 g/m$^2$; a net porosity of about 445 CORESTA units; a thickness of about 0.1 mm; an opacity of about 78 percent; a brightness of about 88 percent; and has a lineny appearance.

The filter element is manufactured using conventional cigarette filter making technology from a cellulose acetate tow item (3.3 denier per filament, 44,000 total denier) and circumscribing paper plug wrap.

The tobacco rod and filter element have similar circumferences, are aligned in an abutting, end-to-end relationship, and are secured together using tipping material, as described in Example 1. The paper wrapper is positioned such that the "felt side" thereof faces the outside of the cigarette.

The cigarette is smoked and delivers tobacco smoke flavor as well as an acceptable draft resistance. The mainstream smoke does not have an off-taste, and the cigarette yields desirable smoking satisfaction. The cigarette burns at an acceptable rate and yields a cohesive ash having good integrity. The cigarette provides an "after-taste" which is not highly intense and is not undesirable in its organoleptic character.

EXAMPLE 3

Cigarettes having lengths of about 84 mm and circumferences of about 24.85 mm have tobacco rod lengths of about 57 mm and filter element lengths of about 27 mm. The tobacco rod includes a charge of tobacco cut filler, weighing about 0.7 g to about 0.75 g, contained in a circumscribing cigarette paper wrapper. The cut filler employed in providing the tobacco rod is in the form of strands of tobacco cut at about 32 cuts per inch. The tobacco cut filler includes an "American blend" of tobacco material.

The paper wrapper includes about 72 parts of the wood pulp described in Example 1; about 23 parts of the precipitated calcium carbonate described in Example 1; and about 5 parts of the fibrous calcium sulfate described in Example 1. The paper is manufactured as described in Example 1.

The paper wrapper exhibits a basis weight of about 6.5 g/m$^2$; a net porosity of about 429 CORESTA units; a thickness of about 0.1 mm; an opacity of about 80 percent; a brightness of about 88.5 percent; and has a lineny appearance.

The filter element is manufactured using conventional cigarette filter making technology from a cellulose acetate tow item (3.3 denier per filament, 44,000 total denier) and circumscribing paper plug wrap.

The tobacco rod and filter element have similar circumferences, are aligned in an abutting, end-to-end relationship, and are secured together using tipping material, as described in Example 1. The paper wrapper is positioned such that the "felt side" thereof faces the outside of the cigarette.

The cigarette is smoked and delivers tobacco smoke flavor as well as an acceptable draft resistance. The mainstream smoke does not have an off-taste, and the cigarette yields desirable smoking satisfaction. The cigarette burns at an acceptable rate and yields a cohesive ash having good integrity. The cigarette provides an "after-taste" which is not highly intense and is not undesirable in its organoleptic character.

EXAMPLE 4

Cigarettes having lengths of about 99 mm and circumferences of about 24.85 mm have tobacco rod lengths of about 68 mm and filter element lengths of about 31 mm. The tobacco rod includes a charge of tobacco cut filler contained in a circumscribing cigarette paper wrapper. The cut filler employed in providing the tobacco rod is in the form of strands of tobacco cut at about 32 cuts per inch. The tobacco cut filler is a blend of 77 parts volume expanded flue-cured tobacco lamina, 17 parts Oriental tobaccos and 6 parts Maryland tobacco.

The paper wrapper includes about 6 parts fibrous calcium sulfate described in Example 1; about 15 parts particulate calcium carbonate; about 25 parts precipitated magnesium hydroxide; and about 54 parts flax fiber. The paper is manufactured essentially as described in U.S. Pat. No. 4,450,847 to Owens. The paper exhibits a basis weight of about 45 g/m$^2$. Potassium acetate is applied to the paper as a burn enhancer, and is applied so that the paper contains about 19 mg alkali metal ions per gram of base sheet.

The filter element is manufactured using conventional cigarette filter making technology from a cellulose acetate tow item (8 denier per filament, 40,000 total denier) and circumscribing paper plug wrap.

The tobacco rod and filter element are aligned in an abutting, end-to-end relationship, and secured together using tipping material. The cigarette is air diluted to 25 percent air dilution.

The cigarette is smoked and delivers a rich tobacco flavor as well as an acceptable draft resistance. The mainstream smoke is not harsh and the cigarette yields desirable smoking satisfaction. The cigarette yields low levels of visible sidestream smoke. The cigarette yields an ash which is cohesive and adheres tightly to the tobacco ash, as compared to a similar cigarette manufactured using a similar paper wrapper but not incorporating the fibrous calcium sulfate.

EXAMPLE 5

Cigarette paper wrappers are provided, essentially as described in Example 4; and cigarettes are manufactured from such paper wrappers, essentially as described in Example 4. The paper wrapper includes about 25 parts precipitated magnesium hydroxide, about 15 parts particulate calcium carbonate, about 12 parts fibrous calcium sulfate described in Example 1, and about 48 parts flax fiber.

EXAMPLE 6

Cigarette paper wrappers are provided, essentially as described in Example 4; and cigarettes are manufactured from such paper wrappers, essentially as described in Example 4. The paper wrapper includes about 25 parts precipitated magnesium hydroxide, about 15 parts particulate calcium carbonate, about 12 parts fibrous calcium sulfate available as Franklin Fiber H-45 from U.S. Gypsum Corp., and about 48 parts flax fiber.

What is claimed is:

1. A cigarette including smokable cut filler material to be burned to yield smoke contained in a circumscribing wrapping material so as to provide a smokable rod having open ends to expose the smokable material, the packing density of the smokable material within the rod ranging from about 100 mg/cm$^3$ to about 300 mg/cm$^3$; the wrapping material to be burned along with the smokable material and comprising (i) a cellulosic base web, and (ii) inorganic filler material including calcium sulfate.

2. The cigarette of claim 1 wherein the calcium sulfate has a fibrous form.

3. The cigarette of clam 2 wherein the cellulosic base web of the wrapping material includes wood pulp, flax fibers, or a combination thereof.

4. The cigarette of claim 1 wherein the wrapping material exhibits a basis weight of about 10 g/m$^2$ to about 40 g/m$^2$.

5. The cigarette of claim 2 wherein the wrapping material exhibits a basis weight of less than about 50 g/m$^2$.

6. The cigarette of claim 2 or 4 wherein the wrapping material exhibits an inherent permeability of less than about 450 CORESTA units.

7. The cigarette of claim 2 wherein the wrapping material has a thickness of less than about 0.3 mm.

8. The cigarette of claim 2 wherein the wrapping material contains about 45 to about 85 weight percent cellulosic base web, and about 15 to about 55 weight percent inorganic filler material.

9. The cigarette of claim 2 wherein essentially all of the inorganic filler material of the wrapping material is fibers of calcium sulfate.

10. The cigarette of claim 2 or 8 wherein the wrapping material includes at least one other inorganic filler material.

11. The cigarette of claim 10 wherein the other inorganic filler material of the wrapping material includes particulates of calcium carbonate.

12. The cigarette of claim 1 whrein the calcium sulfate is fibers of calcium sulfate having aspect ratios of about 30 to about 60.

13. The cigarette of claim 10 wherein the other inorganic filler of the wrapping material includes particles of agglomerated calcium carbonate.

14. The cigarette of cliam 2 or 13 wherein the wrapping material has a thickness of about 0.1 mm or less.

15. The cigarette of claim 2 wherein, at least about 5 weight percent of the wrapping material is calcium sulfate fibers.

16. The cigarette of claim 2 wherein the wrapping material further includes at least one burn enhancer.

17. The cigarette of claim 2 wherein the inorganic filler material consists essentially of particles of calcium carbonate and fibrous calcium sulfate.

18. The cigarette of claim 9 wherein the other inorganic filler of the wrapping material includes calcium carbonate and magnesium hydroxide.

* * * * *

UNITED STATES PATENT AND TRADEMARK OFFICE

CERTIFICATE OF CORRECTION

PATENT NO. : 5,103,844

DATED : April 14, 1992

INVENTOR(S) : Rhonda F. Hayden et al.

It is certified that error appears in the above—identified patent and that said Letters Patent is hereby corrected as shown below:

Col. 2, line 17, "ad3acent" should be --adjacent--.
Col. 3, line 64, "abdut" should be --about--.
Col. 5, line 55, "0.9" should be --0.95--.
Col. 7, line 5, after "to" (second occurrence), insert --about 12 percent, and frequently up to about 6 percent,--.
Col. 9, line 53, "6.5" should be --26.5--.

Col. 12, line 12, "claim 1" should be --claim 2--.
Col. 12, line 28, "claim 9" should be --claim 10--.

Signed and Sealed this

Seventeenth Day of August, 1993

Bruce Lehman

*Attest:*

BRUCE LEHMAN

*Attesting Officer*

*Commissioner of Patents and Trademarks*